US011198594B2

(12) United States Patent
Beauchaud et al.

(10) Patent No.: US 11,198,594 B2
(45) Date of Patent: Dec. 14, 2021

(54) ELEVATOR CAR APRON

(71) Applicant: Otis Elevator Company, Farmington, CT (US)

(72) Inventors: Frederic Beauchaud, Coullons (FR); Guillaume Trouvain, Gien (FR); Etienne Billant, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 208 days.

(21) Appl. No.: 16/527,736

(22) Filed: Jul. 31, 2019

(65) Prior Publication Data

US 2020/0039796 A1 Feb. 6, 2020

(30) Foreign Application Priority Data

Aug. 6, 2018 (EP) ..... 18306076

(51) Int. Cl.
*B66B 13/28* (2006.01)
*B66B 11/02* (2006.01)

(52) U.S. Cl.
CPC ..... *B66B 13/285* (2013.01); *B66B 11/0226* (2013.01)

(58) Field of Classification Search
CPC ..... B66B 13/285
See application file for complete search history.

(56) References Cited

U.S. PATENT DOCUMENTS 9,227,817 B2 1/2016 Fauconnet et al.

FOREIGN PATENT DOCUMENTS

| | | | | |
|---|---|---|---|---|
| CN | 1982195 | A | 6/2007 | |
| CN | 102120542 | A | 7/2011 | |
| CN | 104627792 | B | 2/2017 | |
| CN | 205932848 | U | 2/2017 | |
| CN | 106744185 | A | 5/2017 | |
| CN | 206872226 | U | 1/2018 | |
| CN | 207375550 | U | 5/2018 | |
| DE | 10052459 | A1 * | 5/2002 | ..... B66B 5/005 |
| DE | 202007013602 | U1 | 2/2009 | |

(Continued)

OTHER PUBLICATIONS

Machine Translation of DE 10 2008 038408.*

(Continued)

*Primary Examiner* — Diem M Tran
(74) *Attorney, Agent, or Firm* — Cantor Colburn LLP

(57) ABSTRACT

Elevator systems including an elevator car having a car door sill and car apron assembly movable along an elevator shaft having a pit floor, are provided. The car apron assembly includes a collapsible guard with at least one guard element that is moveable from a deployed state to a compressed state. In the compressed state the at least one guard element is positioned within the car door sill. A guard frame is fixedly connected to the at least one guard element by one or more reinforcement elements, a translating member is arranged at each end of the guard frame, and a guide member fixedly connected to the elevator car. The collapsible guard is urged from the deployed state toward the compressed state as the guard element contacts the pit floor, and when transitioning from the deployed state to the compressed state, the translating member translates along the guide member.

20 Claims, 5 Drawing Sheets

(56) References Cited

FOREIGN PATENT DOCUMENTS

| | | | | |
|---|---|---|---|---|
| DE | 102008038408 | A1 | 3/2009 | |
| EP | 1854758 | A1 | 11/2007 | |
| EP | 2039644 | B1 | 3/2009 | |
| EP | 2138443 | A1 | 12/2009 | |
| EP | 2305593 | A1 | 3/2012 | |
| EP | 2581334 | A1 * | 4/2013 | ..... B66B 13/285 |
| EP | 3012218 | B1 | 2/2017 | |
| FR | 2841886 | A1 | 1/2004 | |
| JP | S5333164 | U | 3/1978 | |
| JP | H1149463 | A | 2/1999 | |
| WO | 2008110696 | A1 | 9/2008 | |

OTHER PUBLICATIONS

European Office Action for European Application No. 18306076.3, International Filing Date Aug. 6, 2018, dated Jun. 4, 2020, 6 pages.
European Search Report for European Application No. 18306076.3, International Filing Date Aug. 6, 2018, dated Feb. 13, 2019, 9 pages.
W+W Aufzugkomponenten. Elevator Equipment Limited. Universal Solid Car Apron/Toe Guard. Retreived from: http://www.elevatorequipment.co.uk/en8120-product-range/universal-solid-car-apron-toe-guard. Date Assessed: Aug. 20, 2018. 3 Pages.

* cited by examiner

ELEVATOR CAR APRON

CROSS REFERENCE TO RELATED APPLICATIONS

This application claims the benefit of European Application No. 18306076.3, filed Aug. 6, 2018, which is incorporated herein by reference in its entirety.

BACKGROUND

The subject matter disclosed herein generally relates to elevator systems and, more particularly, to elevator car aprons and safety mechanisms for elevator systems.

Traditional safety requirements for elevator shafts have led to larger spaces both at the top and bottom of the elevator shaft. However, such enlarged spaces may be disadvantageous for architectural reasons. Thus, elevator manufacturers have attempted to reduce hoistway or elevator shaft overhead dimensions and pit depth while maintaining safety features. Mechanics currently go to the top of car, or on top thereof, or in the pit, for inspection or maintenance activity of various components of an elevator car system. Thus, safety spaces or volumes are employed within the elevator shaft to protect a mechanic in the event of an emergency and thus require increased overhead and pit dimensions.

Further advancements and designs have attempted to completely eliminate the need for a mechanic to enter the hoistway, thus improving safety. An advantage of eliminating the need for entering the hoistway is that the traditional large pit depths may be reduced such that very small pit depths may be employed in such elevator systems.

Elevator cars typically include a toe guard or car apron situated beneath the elevator car door. The car apron is arranged to prevent persons from falling into an elevator shaft if the elevator car is not located at a landing and the landing doors are opened. The car apron is typically rigid and has a nominal height of about 750 mm. A significant amount of clearance beneath the elevator car is required to avoid contact between the car apron and the bottom of the elevator shaft when the elevator car is situated at a lowest landing. Such contact could cause significant damage to the car apron due to the rigid and fixed nature of the car apron. Accordingly, retractable car aprons have been proposed to address the above issues for systems employing small pit depths. However, improved systems may be advantageous.

BRIEF SUMMARY

According to some embodiments, elevator systems are provided. The elevator systems include an elevator car movable along an elevator shaft, the shaft having a pit floor, the elevator car having an elevator car door sill and a car apron assembly. The car apron assembly includes a collapsible guard comprising at least one guard element that is moveable from a deployed state to a compressed state, wherein in the compressed state the at least one guard element is positioned within the car door sill, a guard frame fixedly connected to the at least one guard element by one or more reinforcement elements, a translating member arranged at each end of the guard frame, and a guide member fixedly connected to the elevator car. The collapsible guard is urged from the deployed state toward the compressed state as the at least one guard element contacts the pit floor, when transitioning from the deployed state to the compressed state, the translating member translates along the guide member; and when in the deployed state the collapsible guard extends below the elevator car to block an open landing door that is lower than the elevator car when the elevator car is positioned offset and above an adjacent landing.

In addition to one or more of the features described above, or as an alternative, further embodiments may include that the guide member is fixedly mounted to at least one of a frame of the elevator car, a panel of the elevator car, and a platform of the elevator car.

In addition to one or more of the features described above, or as an alternative, further embodiments may include that the collapsible guard has as deployed length LD in the deployed state and a compressed length LC in the compressed state, wherein the compressed length LC is less than the deployed length LD.

In addition to one or more of the features described above, or as an alternative, further embodiments may include that the collapsible guard has a length of between 750 mm and 5 meters in the deployed state and between 0 and 750 mm in the compressed state, in particular having a length of about 750 mm in the deployed state and about 180 mm in the compressed state.

In addition to one or more of the features described above, or as an alternative, further embodiments may include that the collapsible guard comprises a plurality of guard elements, wherein the guard elements form a telescopic collapsible guard.

In addition to one or more of the features described above, or as an alternative, further embodiments may include that the at least one guard element is a semi-rigid curtain extending between the car door sill and the one or more reinforcement elements.

In addition to one or more of the features described above, or as an alternative, further embodiments may include that the semi-rigid curtain is formed from at least one of rubber, plastic, fabric, metallic chain links, plastic chain links, metal mesh, and plastic mesh.

In addition to one or more of the features described above, or as an alternative, further embodiments may include that the collapsible guard provides a horizontal resistance of between 200-700 N with a 5-50 mm deflection, in particular a horizontal resistance of about 300 N with about a 35 mm deflection.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited by the accompanying figures in which like reference numerals indicate similar elements.

DETAILED DESCRIPTION

Figure 1:
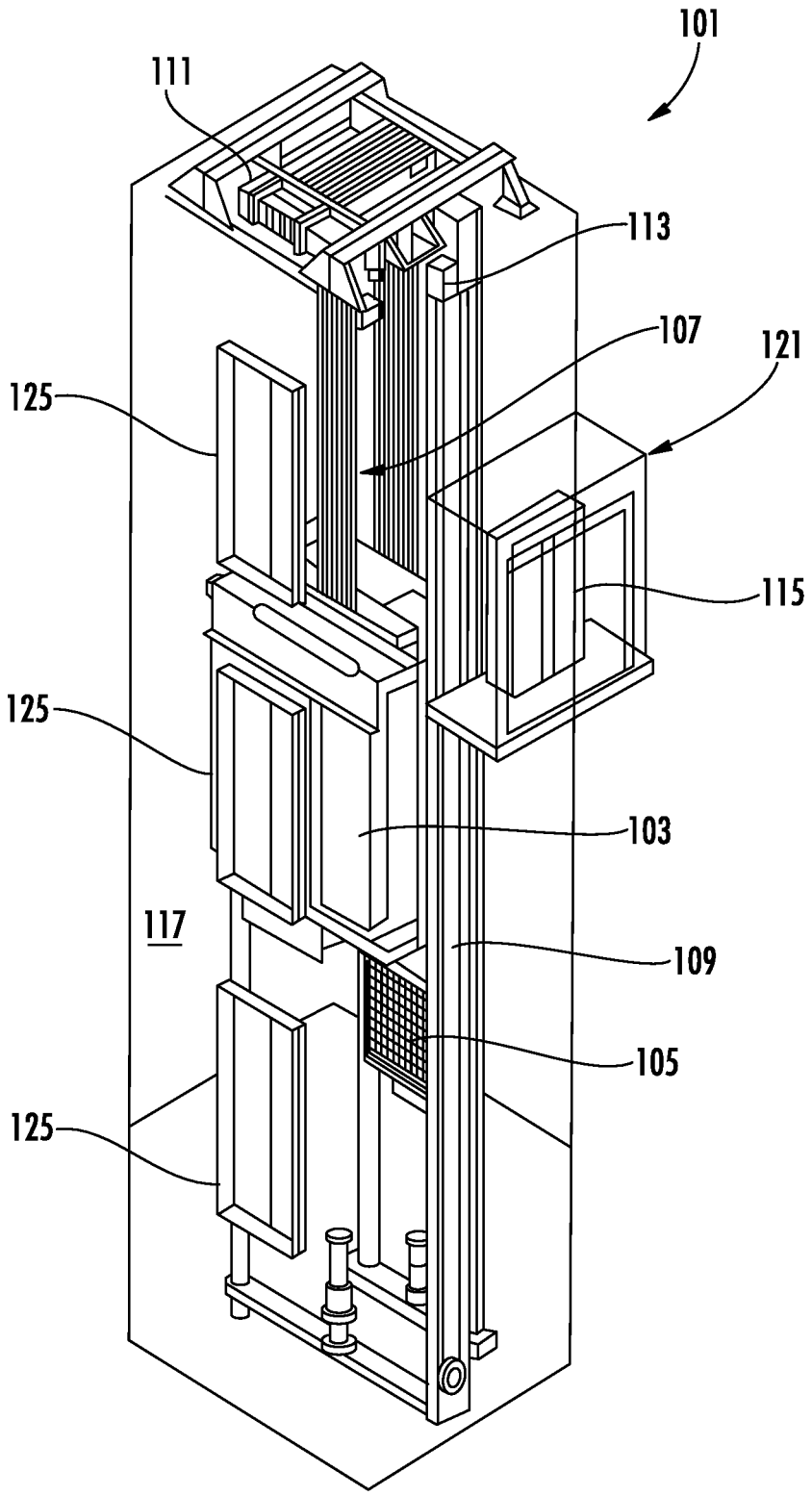
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter-weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
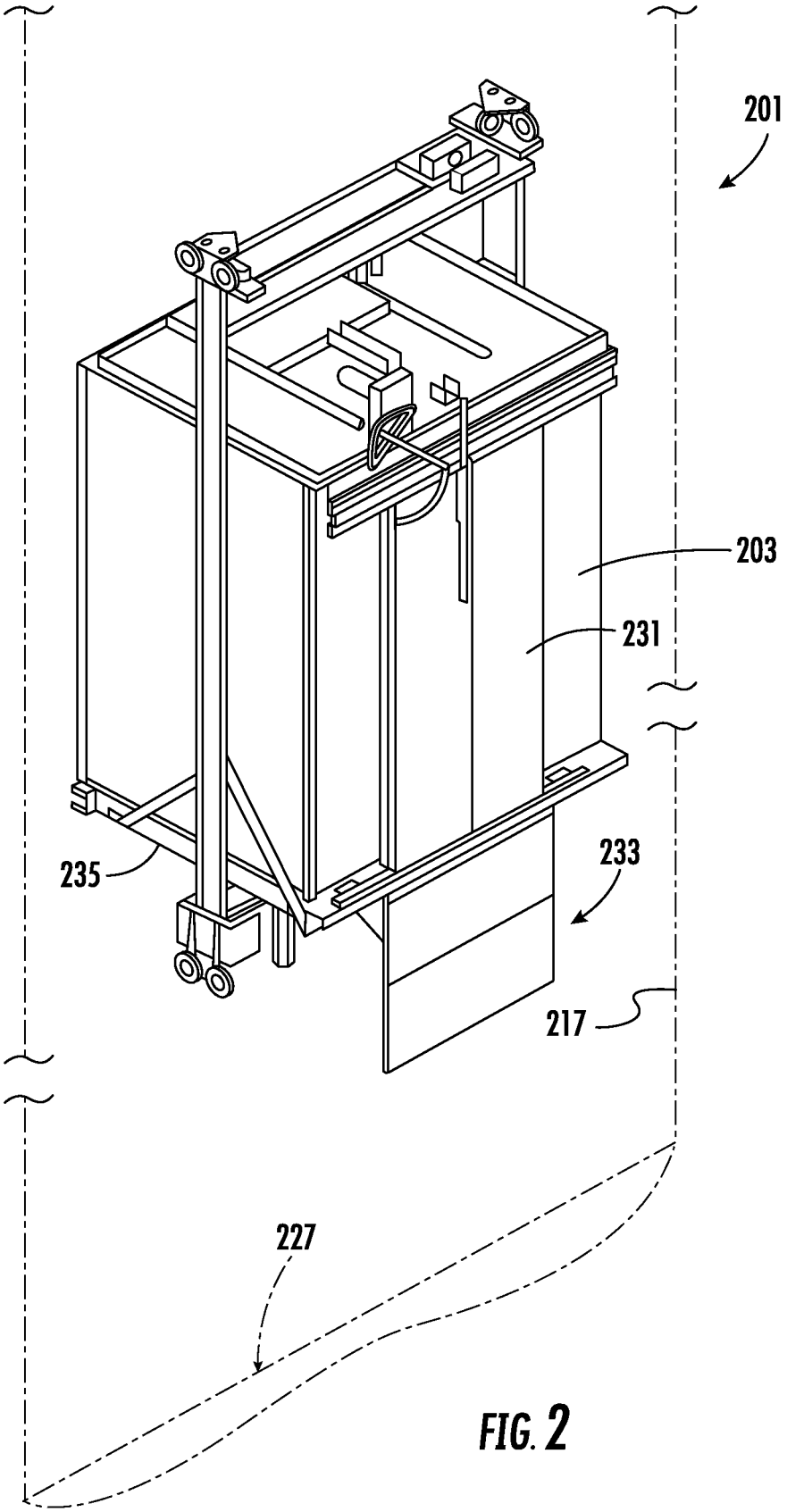
FIG. 2 is a schematic illustration of an elevator system that may employ embodiments of the present disclosure.

FIG. 2 is a schematic illustration of an elevator system 201 that can incorporate embodiments of the present disclosure. The elevator system 201 includes an elevator car 203 that is moveable within an elevator shaft 217. A pit floor 227 is shown at the bottom of the elevator shaft 217. The elevator car 203 includes elevator car doors 231 that open and close to allow ingress/egress to/from the elevator car 203 at one or more landings of the elevator system 201.

A car apron assembly 233 is provided on the elevator car 203 to cover the space between a bottom 235 of the elevator car 203 and an adjacent landing, when the elevator car 203 is in the proximity of the landing. If, for any reason, the landing doors (not shown) were to open before the elevator car 203 is properly aligned with the landing, the car apron assembly 233 is provided to at least partially block the open landing door. One function of the car apron assembly 233 is to prevent people from falling in the elevator shaft 217 during rescue operations when the elevator car door 231 is not aligned with a landing door.

However, the presence of the car apron assembly 233 impacts how close the elevator car 203 can get to the pit floor 227 of the elevator shaft 217. The example car apron assembly 233 of the present embodiment is collapsible or movable between an extended state (shown in FIG. 2) and a retracted state (not shown) that allows the elevator car 203 to descend closer to the pit floor 227 than may otherwise be possible to if the car apron assembly 233 remained in the extended state. That is, the dimensions of the car apron assembly 233 in the retracted state are significantly less than the dimensions of the car apron assembly 233 in an extended state.

In accordance with some embodiments of the present disclosure, car apron assemblies that provide landing doorway coverage and enable the use of small or low clearance pit depths in elevator systems are described. In some embodiments, the coverage provided by the car apron assemblies described herein may provide full or less-than-full coverage (e.g., ¾, ½, etc.) of an elevator landing doorway opening. In accordance with embodiments of the present disclosure, car apron assemblies are arranged to close the gap between an elevator car door sill and a landing door sill using a semi-rigid and flexible curtain having a length that can extend to a value equal to the landing door opening height. The semi-rigid curtain is fixed at its upper part below the elevator car door sill and is maintained vertical during operation of the elevator car due to a support frame and reinforcement element that is mounted to the elevator car. The semi-rigid curtain is arranged to provide a horizontal resistance (e.g., 300N, 35 mm deflection) in the event of a hazard (e.g., a person contacting the semi-rigid curtain). The semi-rigid curtain provides a constant and always deployed extension to block access to the elevator shaft below the elevator car. However, when the elevator car reaches the pit floor, the semi-rigid curtain may be compressed (e.g., collapse or telescope closed) when the lower part thereof contacts the pit floor.

Figure 3A:
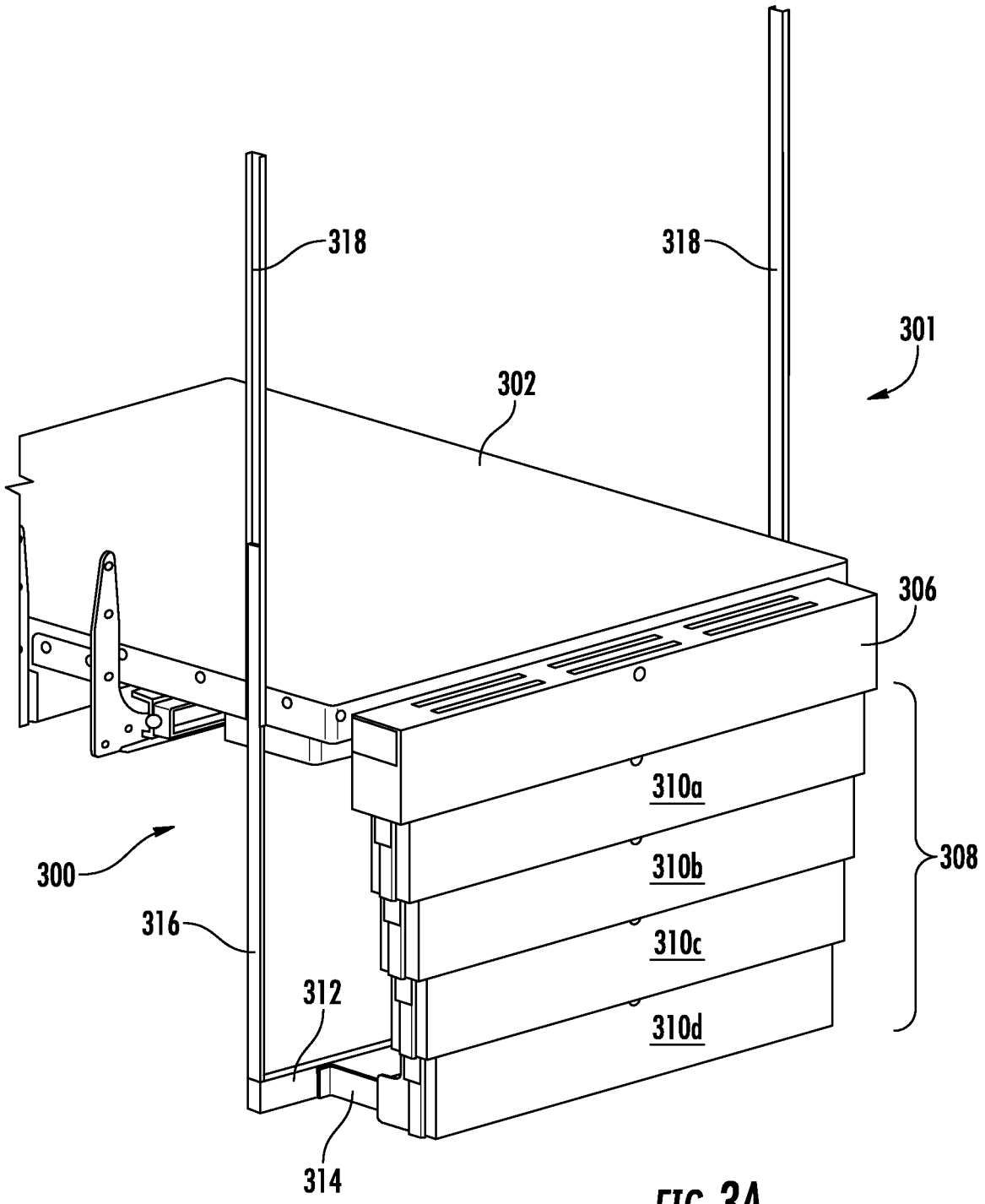
FIG. 3A is an isometric schematic illustration of an elevator system having a car apron assembly in accordance with an embodiment of the present disclosure.
Figure 3C:
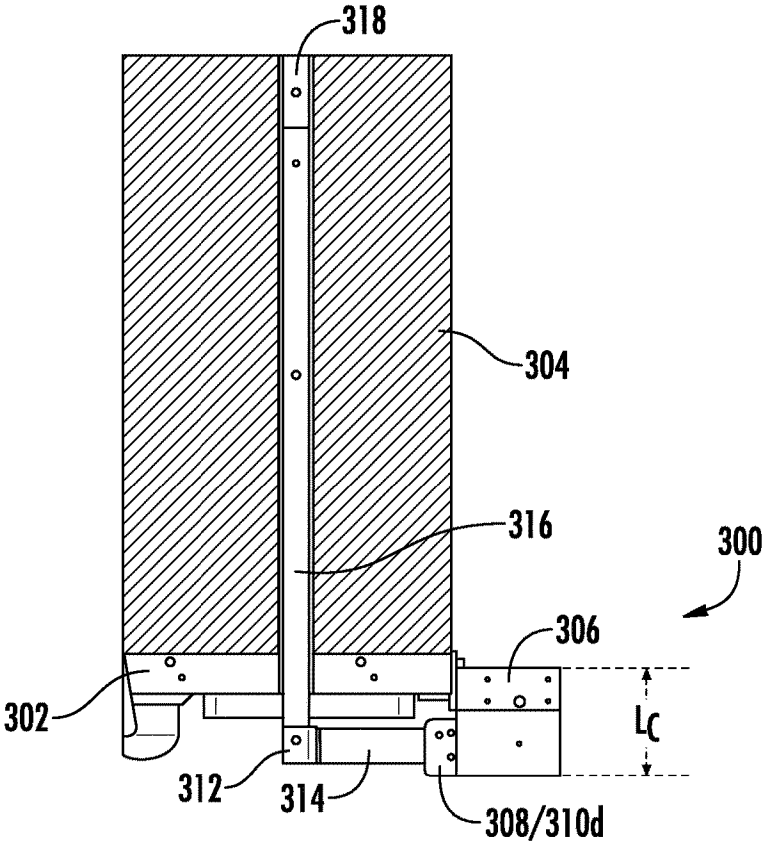
FIG. 3C is a side elevation schematic illustration of the elevator system of FIG. 3A showing the car apron assembly in a compressed state.
Figure 3B:
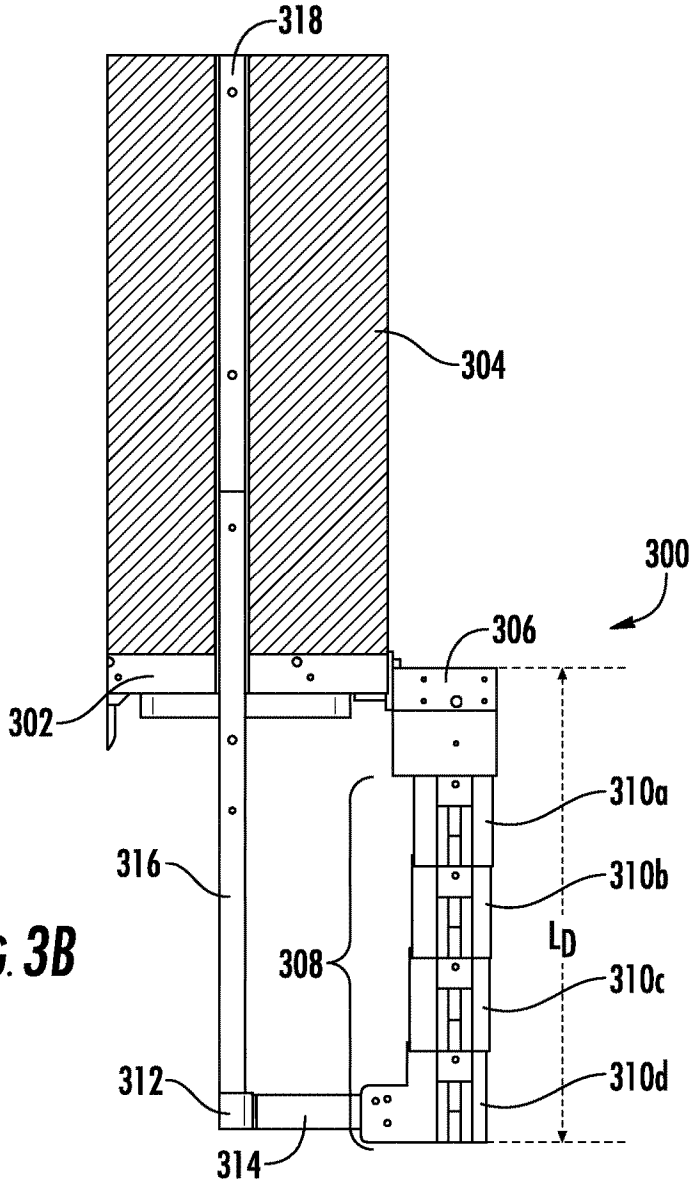
FIG. 3B is a side elevation schematic illustration of the elevator system of FIG. 3A showing the car apron assembly in the deployed state.

Turning now to FIGS. 3A-3C, schematic illustrations of an elevator system 301 having a car apron assembly 300 in accordance with an embodiment of the present disclosure are shown. The elevator system 301 includes an elevator car that is movable within an elevator shaft between a number of different landings along the elevator shaft. FIG. 3A is an isometric illustration of the elevator system 301 with the car apron assembly 300 in a deployed state. FIG. 3B is a side elevation view of the car apron assembly 300 in the deployed state. FIG. 3C is a side elevation view of the car apron assembly 300 in a compressed state.

The elevator car includes a platform 302 and a plurality of panels 304 (FIGS. 3B-3C) that are arranged to define, in part, an elevator cab or interior space. Further, the platform 302 includes an elevator car door sill 306 that is positioned beneath elevator car doors, as will be appreciated by those of skill in the art. As shown in FIGS. 1-2, the elevator shaft extends to a pit floor at the bottom thereof.

The car apron assembly 300 includes a collapsible guard 308 that is attached to and suspended from the elevator car. As will be appreciated by those of skill in the art, the collapsible guard 308 may be attached to the platform 302 of the elevator car. More particularly, the collapsible guard 308 may be stowable or collapsible into the car door sill 306. The collapsible guard 308 comprises a plurality of guard elements 310*a*-310*d* that are configured to form a telescopic arrangement with each lower guard element 310*a*-310*d* being slightly smaller than the one above it such that each guard element 310*b*-310*d* can fit inside the one above it, and the top guard element 310*a* fits into the car door sill 306.

The collapsible guard 308 extends downward from and below the platform 302, as shown in FIGS. 3A-3B. As shown in FIG. 3B, the collapsible guard 308 extends from the elevator car door sill 306 a deployed length LD and is supported by a guard frame 312 and a reinforcement element 314. The guard frame 312 and the reinforcement element 314 provide rigidity, support, and weight to the collapsible guard 308. The guard frame 312, in some embodiments, may be a metal rod frame that extends a width of the collapsible guard 308 to provide support at the bottom of the collapsible guard 308 and to ensure the collapsible guard 308 remains aligned with an orientation of the car door sill 306. The guard frame 312 is mounted at the end of translating members 316 arranged at opposing ends of the guard frame 312. The translating members 316 are moveable along guide members 318 that are fixedly connected to the elevator car, e.g., to the panels 304 of the elevator car and/or to the platform 302 of the elevator car.

The collapsible guard 308 extends a deployed length LD during normal operation of the elevator car, as shown in FIG. 3B. The deployed length LD may have any desired length to provide fall protection in the event that a landing door is opened and the elevator car is located above the opening. In some non-limiting embodiments, the deployed length $L_D$ may be 750 mm or greater, and in some embodiment may be between 750-5000 mm, and in some embodiments, the deployed length $L_D$ may be about 750 mm.

When the elevator car travels to the pit of the elevator shaft, the car door sill 306 will approach the pit floor to a distance that is less than the deployed length $L_D$ of the collapsible guard 308. When this occurs, the bottom or lowest guard element 310*d* will contact the pit floor. This contact and any further downward motion by the elevator car will cause the guard element 310*d* to slide into the next guard element 310*c*, and so on. As shown in FIG. 3C, the car apron assembly 300 is shown in a fully compressed or collapsed state, with the collapsible guard 308 having a collapsed length $L_C$. In the fully collapsed state, all of the guard elements 310*a*-310*d* are positioned within the car door sill 306.

The compression of the collapsible guard 308 is achieved by application of force from the pit floor in contact with the guard frame 312. As the elevator car moves downward toward the pit floor, the guard elements 310*a*-310*d* will collapse into each other and into the car door sill 306 without interfering with the operation of the elevator car. Then, when the elevator car moves back upward away from the pit floor, the guard elements 310*a*-310*d* redeploy or extend back to the full length deployed length $L_D$ without damage occurring thereto.

The guard frame 312 and reinforcement element 314 are arranged to attach to at least one of the guard elements 310*a*-310*d*. As shown, in this illustrative embodiment, the reinforcement elements 314 rigidly connect the lowest guard element 310*d* to the guard frame 312. The guard frame 312 extends a horizontal width of the guard elements 310*a*-310*d* and also the width of the car door sill 306. As such, the guard frame 312 can provide rigid support and reinforcement, through the reinforcement element 314, to the car apron assembly 300.

In some non-limiting embodiments, the car apron assembly 300 may be arranged to meet certain predetermined criteria. For example, the deployed length $L_D$ of the collapsible guard 308 may be at least two meters to ensure that a landing door opening would be covered during a rescue operation. Further, the guard frame 312, the reinforcement element 314, and the guard elements 310*a*-310*d* of the collapsible guard 308 may be configured to prevent a specific deflection and/or impacts and thus prevent persons or objects from falling into the elevator shaft. Such configuration may include material selection. For example, the car apron assembly 300 may be arranged to provide a horizontal resistance (e.g., from a landing into the elevator shaft) of between 200-700 N with between a 5-50 mm deflection. Further, in some embodiments, the resistance may be between 300-500 N with a 15-35 mm deflection. In some embodiments, the apron assembly may be configured to have a maximal permanent deflection of about 1 mm.

It is noted that in addition to providing a safety cover or protection at a landing, the car apron assembly 300 is arranged to allow for simple operation at the lowest level of the elevator shaft and/or at the pit floor. For example, the collapsible guard 308 may be collapsible such that when the lowest guard element 310*d* of the car apron assembly 300 contacts the pit floor, the collapsible guard 308 may compress to a compressed state. For example, in one non-limiting example, the semi-rigid curtain may have a deployed length $L_D$ of greater than 750 mm, and a collapsed length $L_D$ of less than 750 mm. Further, in some non-limiting embodiments, the deployed length $L_D$ may be between 750 mm and 5 meters and the collapsed length $L_C$ may be between 0 and 750 mm. Further still, in some embodiments, the deployed length $L_D$ may be about 750 mm and the collapsed length $L_C$ may be about 180 mm. The fully deployed state may be achieved simply through gravity. That is, the deployed state may be the normal operating state and an upward force applied by the pit floor is required to compress the collapsible guard 308.

Figure 4:
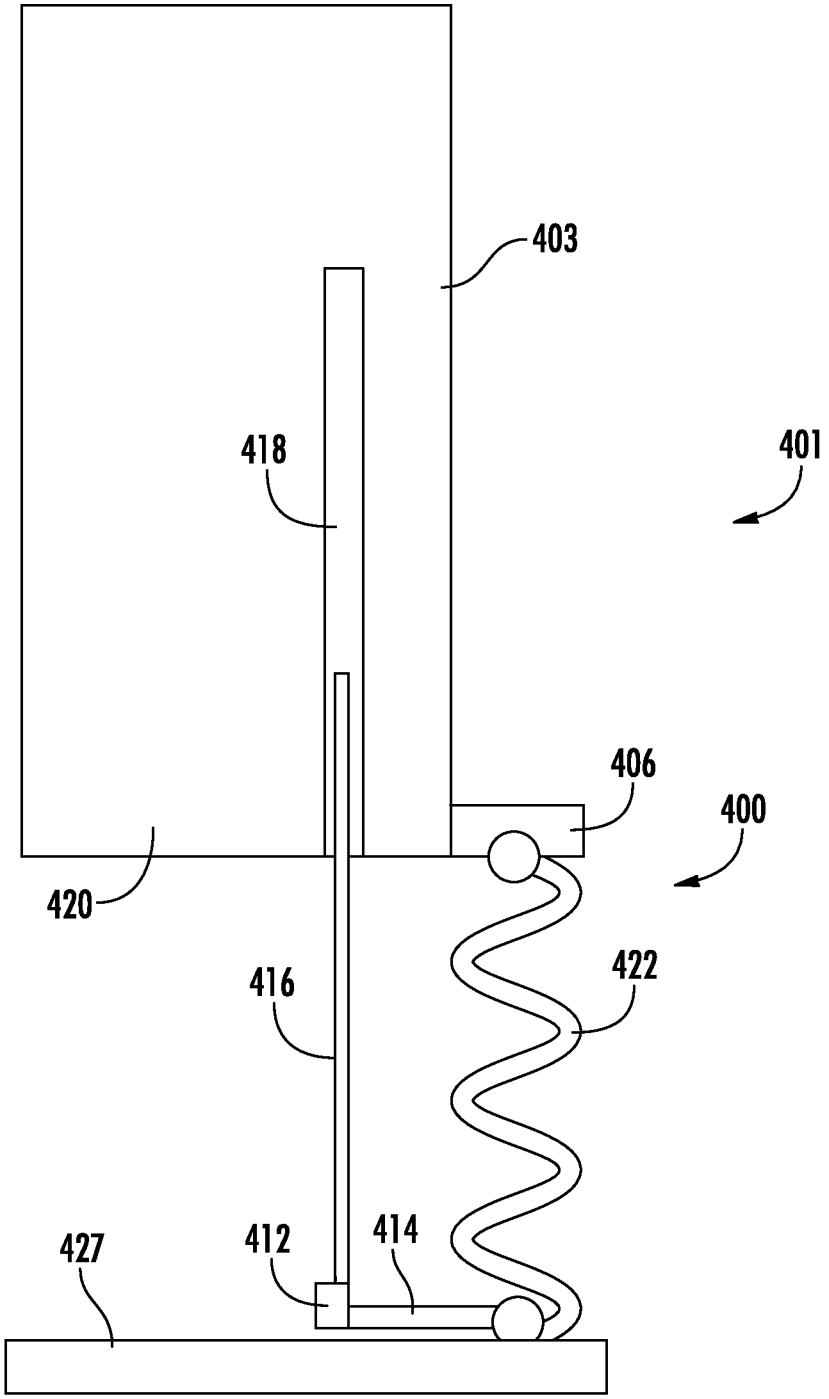
FIG. 4 is a schematic illustration of another embodiment of a car apron assembly in accordance with an embodiment of the present disclosure.

Turning now to FIG. 4, a schematic illustration of an elevator system 401 having a car apron assembly 400 in accordance with an embodiment of the present disclosure is shown. The elevator system 401 includes an elevator car 403 that is movable within an elevator shaft between a number of different landings along the elevator shaft. The elevator car 403 includes a platform an elevator car door sill 406 and a car frame 420, as will be appreciated by those of skill in the art. The elevator shaft extends to a pit floor 427 at the bottom thereof (e.g., similar to that shown in FIGS. 1-2).

The car apron assembly 400 includes a collapsible guard 422 that is attached to and suspended from the elevator car 403. As will be appreciated by those of skill in the art, the collapsible guard 422 may be attached to the car door sill 406 of the elevator car 403. The collapsible guard 422 is stowable or collapsible into the car door sill 406. In this embodiment, the collapsible guard 422 comprises a semi-rigid curtain. To enable the folding of the semi-rigid curtain of the collapsible guard 422 while maintaining appropriate or desirable resistance to force/impact, the semi-rigid curtain may be formed from a specific material that enables the collapsing and re-deployment and have strength thereto. For example, in some embodiments, without limitation, the semi-rigid curtain of the present disclosure may be formed from rubber, plastic (e.g., a tarp-like material, etc.), fabric (e.g., canvas, nylon, etc.), metallic and/or plastic chain links, metal or plastic mesh, etc. In some embodiments, the material of the semi-rigid curtain may be selected to ensure a relatively quiet folding when contacting the pit floor or anchors of the system. Further, the material may be selected to minimize a total weight of the car apron assembly. Moreover, the selection of the material may be made to ensure that in a folded state the semi-rigid curtain may fold into a preset space (e.g., within the car door sill 406), and yet extend to a full length in normal operation.

The collapsible guard 422 extends downward from and below the car door sill 406. Similar to that described above, the collapsible guard 422 extends from the elevator car door sill 406 a deployed length $L_D$ during normal operation and is supported by a guard frame 412 and a reinforcement element 414. The guard frame 412 and the reinforcement element 414 provide rigidity, support, and weight to the collapsible guard 422. The guard frame 412, in some embodiments, may be a metal rod frame that extends a width of the collapsible guard 422 to provide support at the bottom of the collapsible guard 422 and to ensure the collapsible guard 422 remains aligned with an orientation of the car door sill 406. The guard frame 412 is mounted at the end of translating members 416 arranged at opposing ends of the guard frame 412. The translating members 416 are moveable along guide members 418 that are fixedly connected to the elevator car, e.g., to the panels or frame of the elevator car and/or to the platform of the elevator car 403.

The collapsible guard 422 extends a deployed length $L_D$ during normal operation of the elevator car 403. The deployed length $L_D$ may have any desired length to provide fall protection in the event that a landing door is opened and the elevator car is located above the opening. In some non-limiting embodiments, the deployed length $L_D$ may be 750 mm or greater, and in some embodiments may be between 750-5000 mm, and in some embodiments, the deployed length $L_D$ may be about 750 mm. Further, in some non-limiting embodiments, the deployed length may be between 750 mm and 3 meters and the collapsed dimension may be between 0 and 750 mm. Further still, in some embodiments, the deployed length may be about 750 mm and the collapsed dimension may be about 180 mm.

In one non-limiting example, the car apron assembly 400 may be arranged to meet certain predetermined criteria. For example, the deployed length $L_D$ of the semi-rigid curtain of the collapsible guard 422 may be at least two meters to ensure that a landing door opening would be covered during a rescue operation. Further, guard frame 412, reinforcement elements 414, and translating members 416 may be selected and arranged to prevent a specific deflection and/or impacts and thus prevent persons or objects from falling into the elevator shaft. For example, the car apron assembly 400 may be arranged to provide a horizontal resistance (e.g., from the landing into the elevator shaft) of between 200-700 N with between a 5-50 mm deflection. Further, in some embodiments, the resistance may be between 300-500 N with a 15-35 mm deflection. In some embodiments, the apron assembly may be configured to have a maximal permanent deflection of about 1 mm.

As will be appreciated by those of skill in the art, only two example configurations of the collapsible guard are shown and described. However, other physical structures and/or arrangements may be employed without departing from the scope of the present disclosure.

Advantageously, embodiments described herein provide a protective car apron assembly to prevent accidental falls into an elevator shaft when an elevator car is positioned offset from a landing. Further, advantageously, the car apron assemblies of the present disclosure can provide falling hazard protection, enable low pits (due to collapsibility), may be scalable to different elevator systems, and may provide various other advantages as appreciated by those of skill in the art.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system comprising:

an elevator car movable along an elevator shaft, the shaft having a pit floor, the elevator car having an elevator car door sill; and a car apron assembly comprising:

a collapsible guard comprising at least one guard element that is moveable from a deployed state to a compressed state, wherein in the compressed state the at least one guard element is positioned within the car door sill;

a guard frame fixedly connected to the at least one guard element by one or more reinforcement elements;

a translating member arranged at each end of the guard frame; and a guide member fixedly connected to the elevator car, wherein:

the collapsible guard is urged from the deployed state toward the compressed state as the at least one guard element contacts the pit floor, when transitioning from the deployed state to the compressed state, the translating member translates along the guide member; and when in the deployed state the collapsible guard extends below the elevator car to block an open landing door that is lower than the elevator car when the elevator car is positioned offset and above an adjacent landing, wherein the collapsible guard has a length of between 0 and 180 mm in the compressed state.

2. The elevator system of claim 1, wherein the guide member is fixedly mounted to at least one of a frame of the elevator car, a panel of the elevator car, and a platform of the elevator car.

3. The elevator system of claim 2, wherein the collapsible guard has as deployed length LD in the deployed state and a compressed length LC in the compressed state, wherein the compressed length LC is less than the deployed length LD.

4. The elevator system of claim 3, wherein the collapsible guard has a length of between 750 mm and 5 meters in the deployed state.

5. The elevator system of claim 1, wherein the collapsible guard comprises a plurality of guard elements, wherein the guard elements form a telescopic collapsible guard.

6. The elevator system of claim 1, wherein the at least one guard element is a semi-rigid curtain extending between the car door sill and the one or more reinforcement elements.

7. The elevator system of claim 6, wherein the semi-rigid curtain is formed from at least one of rubber, plastic, fabric, metallic chain links, plastic chain links, metal mesh, and plastic mesh.

8. The elevator system of claim 6, wherein the collapsible guard provides a horizontal resistance of between 200-700 N with a 5-50 mm deflection.

9. The elevator system of claim 1, wherein the collapsible guard has as deployed length LD in the deployed state and a compressed length LC in the compressed state, wherein the compressed length LC is less than the deployed length LD.

10. The elevator system of claim 9, wherein the collapsible guard has a length of between 750 mm and 5 meters in the deployed state.

11. The elevator system of claim 9, wherein the collapsible guard comprises a plurality of guard elements, wherein the guard elements form a telescopic collapsible guard.

12. The elevator system of claim 9, wherein the at least one guard element is a semi-rigid curtain extending between the car door sill and the one or more reinforcement elements.

13. The elevator system of claim 12, wherein the semi-rigid curtain is formed from at least one of rubber, plastic, fabric, metallic chain links, plastic chain links, metal mesh, and plastic mesh.

14. The elevator system of claim 9, wherein the collapsible guard provides a horizontal resistance of between 200-700 N with a 5-50 mm deflection.

15. The elevator system of claim 1, wherein the collapsible guard provides a horizontal resistance of between 200-700 N with a 5-50 mm deflection.

16. An elevator system comprising:

an elevator car movable along an elevator shaft, the shaft having a pit floor, the elevator car having an elevator car door sill; and a car apron assembly comprising:

a collapsible guard comprising a plurality of guard element that arranged in a telescopic manner and are moveable from a deployed state to a compressed state, wherein in the compressed state the plurality of guard elements are positioned within the car door sill;

a guard frame fixedly connected to a lowest most guard element of the plurality of guard elements by one or more reinforcement elements;

a translating member arranged at each end of the guard frame; and a guide member fixedly connected to the elevator car, wherein:

the collapsible guard is urged from the deployed state toward the compressed state as the lowest most guard element contacts the pit floor, when transitioning from the deployed state to the compressed state, the translating member translates along the guide member; and when in the deployed state the collapsible guard extends below the elevator car to block an open landing door that is lower than the elevator car when the elevator car is positioned offset and above an adjacent landing.

17. The elevator system of claim 16, wherein the plurality of guard elements are configured such that each lower guard of the plurality of guard elements is smaller than a guard element above such that each guard element fits inside the one above it.

18. The elevator system of claim 17, wherein a topmost guard element of the plurality of guard elements is configured to fit within the elevator car door sill.

19. The elevator system of claim 17, wherein the translating member is coupled to the lowest most guard element of the plurality of guard elements.

20. The elevator system of claim 17, wherein, in the collapsed state, all of the plurality of guard elements are positioned within the elevator car door sill.

* * * * *